US005137311A

United States Patent [19]

Brackmann: Horst

[11] Patent Number: 5,137,311

[45] Date of Patent: Aug. 11, 1992

[54] MOTOR-VEHICLE DOOR LATCH WITH POSITION INDICATOR

[75] Inventor: Brackmann: Horst, Velbert, Fed. Rep. of Germany

[73] Assignee: Kiekert GMBH & Co. Kommanditgesellschaft, Heiligenhaus, Fed. Rep. of Germany

[21] Appl. No.: 753,753

[22] Filed: Sep. 3, 1991

[30] Foreign Application Priority Data

Nov. 27, 1990 [DE] Fed. Rep. of Germany ..... 4037637

[51] Int. Cl.[5] ..... E05C 3/26

[52] U.S. Cl. ..... 292/216; 292/DIG. 43

[58] Field of Search ..... 292/201, DIG. 23, 216, 292/DIG. 43; 200/61.64, 61.67, 61.68

[56] References Cited

U.S. PATENT DOCUMENTS

| | | | |
|---|---|---|---|
| 4,249,161 | 2/1981 | Mohnhaupt | 200/61.67 |
| 4,468,545 | 8/1984 | Slavin | 200/61.64 |
| 4,664,430 | 3/1987 | Bernard | 292/216 |
| 4,735,447 | 4/1988 | Kleefeldt | 292/216 |
| 4,762,348 | 8/1988 | Matsumoto | 292/216 |
| 4,814,557 | 3/1989 | Kato | 292/216 |
| 4,911,488 | 3/1990 | Brackmann et al. | 292/216 |
| 4,971,370 | 11/1990 | Detweiler et al. | 292/DIG. 43 |
| 4,974,886 | 12/1990 | Kleefeldt et al. | 292/216 |
| 4,978,153 | 12/1990 | Hirsch et al. | 292/216 |
| 4,986,098 | 1/1991 | Fisher | 292/216 |

FOREIGN PATENT DOCUMENTS 3406116 3/1989 Fed. Rep. of Germany .

*Primary Examiner*—Eric K. Nicholson

*Attorney, Agent, or Firm*—Herbert Dubno; Andrew Wilford

[57] ABSTRACT

A motor-vehicle door latch for securing together two relatively movable body parts has a housing mounted on one of the parts, a bolt mounted on the other part and engageable in the housing, a fork pivotal in the housing between a latched position engaging around the bolt when therein and an unlatched position permitting the bolt to enter and exit the housing, and a pawl pivotal in the housing between a holding position retaining the fork in the latched position and a freeing position permitting the fork to move between its positions. A release lever engageable with the pawl is pivotal in the housing between a holding position holding the pawl in its freeing position and a freeing position in which it does not impede movement of the pawl between its positions. A position-holding element engageable in the housing with the lever is movable between a blocking position preventing movement of the lever out of the freeing position and an unblocking position permitting movement of the lever between its positions. A switch operatively associated with the holding element generates an output when same is in the blocking position.

4 Claims, 4 Drawing Sheets

MOTOR-VEHICLE DOOR LATCH WITH POSITION INDICATOR

FIELD OF THE INVENTION

The present invention relates to a latch for a motor-vehicle door. More particularly this invention concerns such a latch which is used to hold open the hatch or trunk of a motor vehicle.

BACKGROUND OF THE INVENTION

A standard position-holding motor-vehicle door latch for securing together two relatively movable body parts such as described in German patent 3,406,116 of H. Brackmann has a housing mounted on one of the parts, a bolt mounted on the other part and engageable in the housing, a fork pivotal in the housing between a latched position engaging around the bolt when therein and an unlatched position permitting the bolt to enter and exit the housing, and a pawl pivotal in the housing between a holding position retaining the fork in the latched position and a freeing position permitting the fork to move between its positions. A release lever engageable with the pawl is pivotal in the housing between a holding position holding the pawl in its freeing position and a freeing position in which it does not impede movement of the pawl between its positions. A position-holding element engageable in the housing with the lever is movable between a blocking position preventing movement of the lever out of the freeing position and an unblocking position permitting movement of the lever between its positions. A link couples the element to the fork for putting the element in the unblocking position when the fork is in the open position.

The advantage of such an arrangement is that if for some reason the door, typically a trunk or hatch lid, sticks shut, as happens for example in cold weather when the seal is wet and freezes, the lid can be forced open. If not for the position hold, it would be necessary to pull up on the hood while the latch is being actuated remotely, something impossible for one person.

A disadvantage of this system, however, is that it is possible to actuate the trunk or hatch release and, when same does not open, to subsequently forget that in fact the latch is holding in the open position. Later the hatch or trunk can fly open, creating a potentially very dangerous situation.

OBJECTS OF THE INVENTION

It is therefore an object of the present invention to provide an improved position-holding motor-vehicle door latch.

Another object is the provision of such an improved position-holding motor-vehicle door latch which overcomes the above-given disadvantages, that is which makes it possible to ascertain the position of the latch even if the controlled door does not open.

SUMMARY OF THE INVENTION

A motor-vehicle door latch for securing together two relatively movable body parts has a housing mounted on one of the parts, a bolt mounted on the other part and engageable in the housing, a fork pivotal in the housing between a latched position engaging around the bolt when therein and an unlatched position permitting the bolt to enter and exit the housing, and a pawl pivotal in the housing between a holding position retaining the fork in the latched position and a freeing position permitting the fork to move between its positions. A release lever engageable with the pawl is pivotal in the housing between a holding position holding the pawl in its freeing position and a freeing position in which it does not impede movement of the pawl between its positions. A position-holding element engageable in the housing with the lever is movable between a blocking position preventing movement of the lever out of the freeing position and an unblocking position permitting movement of the lever between its positions. According to the invention a switch operatively associated with the holding element generates an output when same is in the blocking position.

Thus it is possible to remotely determine if the latch is blocked in the position that would allow the door to fly open, even if for some reason it is not open. This provides a high level of security.

According to the invention a motor is provided in the latch for displacing the release lever into the freeing position. A spring urges the holding element into the blocking position and a link is provided that couples the element to the fork for putting the element in the unblocking position when the fork is in the open position. This motor is provided with a rotary cam operatively engageable with the release lever to shift same between its positions.

In accordance with the invention a switch lever operatively engageable with the release lever is movable thereby and another switch is associated with the switch lever and operable by same in the holding position of same. Another abutment or link is provided the fork and the switch lever for actuation of the other switch on displacement of the fork into an intermediate position between its latched and unlatched positions. A motor-control switch engaging the cam is operable thereby.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
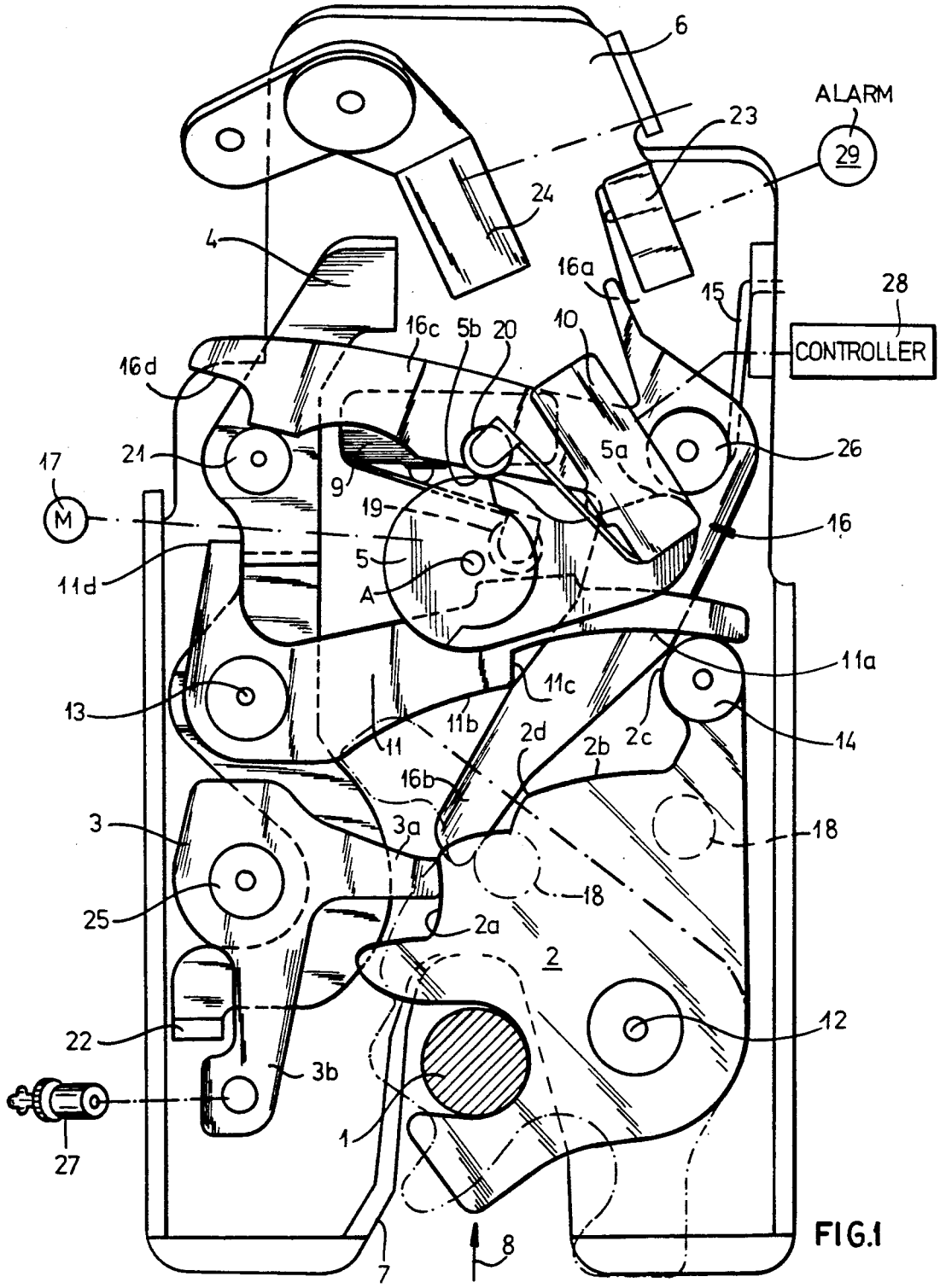
FIG. 1 is a side view of the latch in the latched position and closed position.
Figure 2:
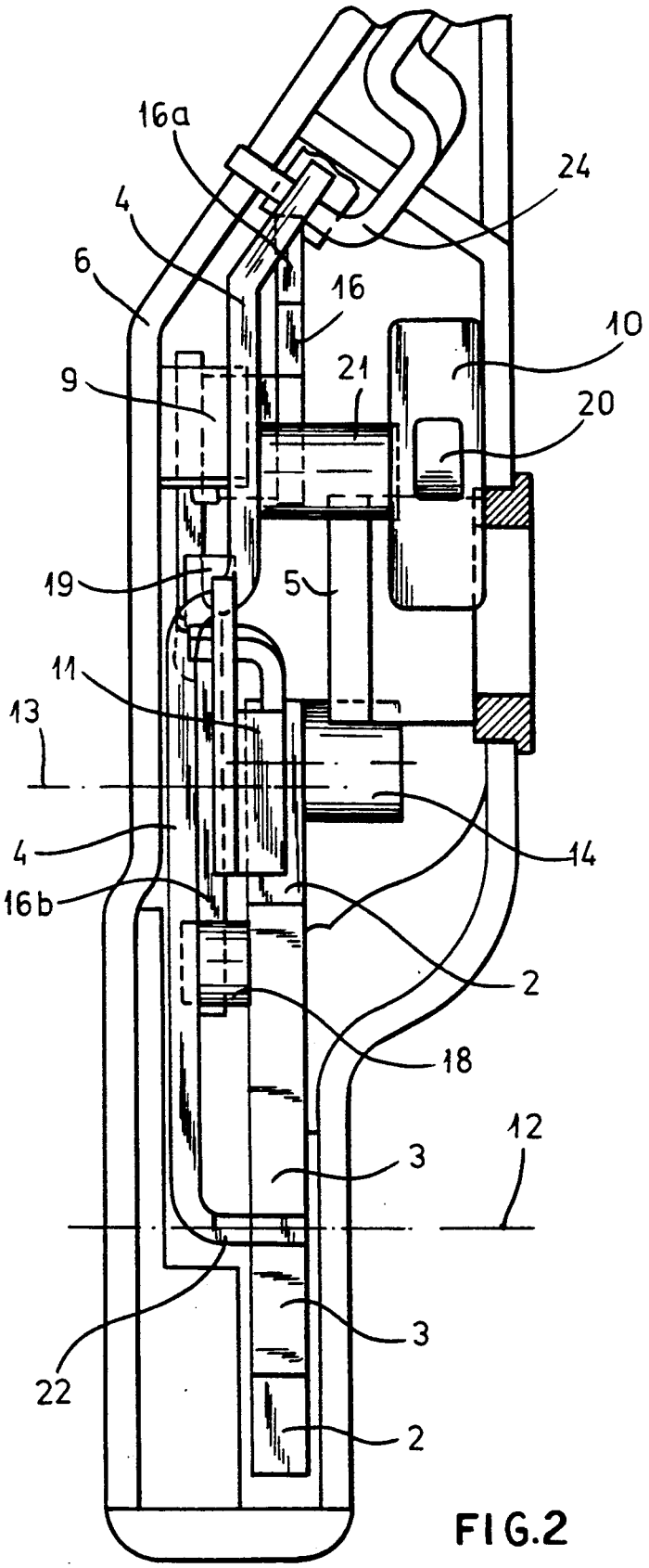
FIG. 2 is an end view with some parts removed for clarity of view.

As seen in FIGS. 1 and 2 a latch according to this invention has a housing 6 formed with a cutout 7 into which a bolt 1 can move in a closing direction 8. This latch is the type used on a trunk lid so that the bolt 1 is mounted on the edge of the trunk opening and the cutout 7 opens vertically downward as illustrated.

Figure 3:
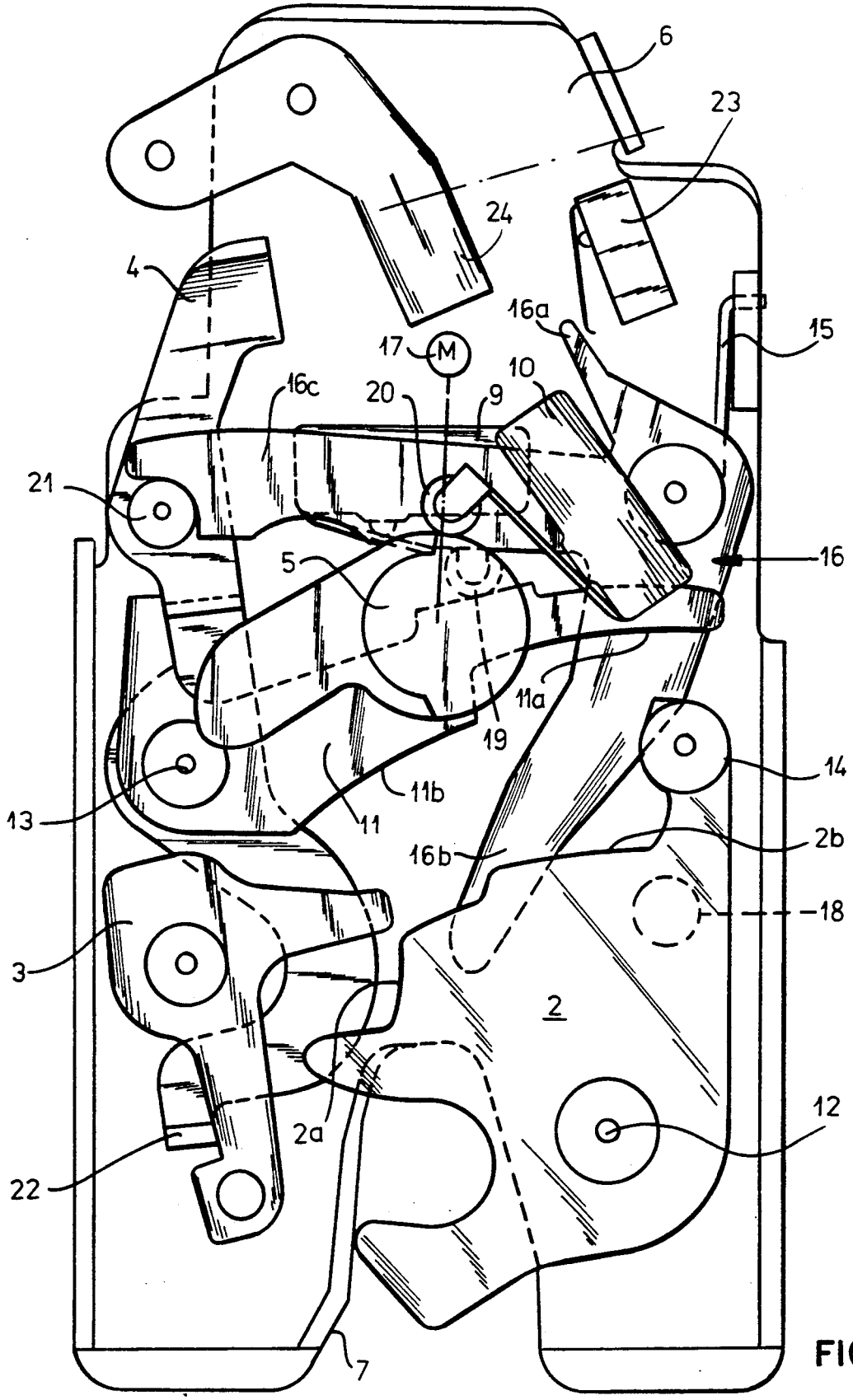
FIG. 3 is a view like FIG. 1 but with the latch in the unlatched but closed position.

The bolt 1 can be retained in the cutout by a fork 2 pivoted at 12 on the housing 1 and formed with a pair of retaining steps **2*a* and 2*d* and with a camming edge 2*b*, and carrying a pusher pin 14 having a pusher edge 2*c*. In turn the fork 2 can be held in place by an arm 3*a* of a retaining pawl 3 pivoted at 25 parallel to the fork 2 and operable directly by a key cylinder 27 mounted on the trunk lid. This pawl 3 can block the fork in either of two positions, on illustrated in FIGS. 1 and 3 and one in FIG. 4, by engagement with the steps 2***a* and 2*d*, respectively. In FIGS. 1 and 3 the fork 2 is shown in the holding position and the pawl is shown in the holding and freeing positions, respectively while in FIG. 4 the pawl is shown in the holding position but the fork 2 is in an intermediate position.

A release lever 4 pivoted at 13 parallel to the axles 12 and 25 has an end 22 that can act on an arm 3*b* of the pawl 3 to move it into the freeing position release it from either of the steps 2*a* or 2*d* and allow the latch to open. This release lever 4 itself can be actuated by a camming formation 5*a* of a cam 5 that is rotatable by a schematically illustrated motor 17 counterclockwise about an axis A parallel to the axes 12, 13, and 25. Limit switches 9 and 10 associated with a controller 28 for the unillustrated motor of the cam 5 are closed respectively to start and stop operation of the motor 17.

A position-storing lever 16 pivoted at an axis 26 parallel to the axles 12 and 25 has an arm 16*a* that can operate a switch 23, an arm 16*b* that can be moved by an abutment pin 18 on the fork 2, and an arm 16*c* formed with a notch 16*d* that can engage in a blocking position over an abutment pin 21 on the lever 4. A spring 15 urges the lever 16 counterclockwise as seen in the drawing. A switching lever 11 pivoted at 13 with the lever 4 has a pair of edges 11*a* and 11*b* separated by a step 11calong which can run another abutment pin 14 of the fork 2, which pin 14 can also be actuated by an end 5*a* of the cam 5. This lever 11 also has an end 11*d* hooked around the lever 4 for joint rotation therewith.

In the closed position of the latch shown in FIGS. 1 and 2 the pawl is braced in its holding position against the step 2*a* of the fork 2 and the bolt 1 is solidly held in the base of the notch 7. The arm 16*c* lies in an unblocking position atop the pin 21 so that the switch 23 is actuated by the arm 16*a* and the lever 11 lies with its edge 11*a* on the pin 14 so that a roller 19 of the switch 9 is not actuated. A roller 20 of the switch 10 lies atop a high portion 5*b* of the cam 5 so that this switch, however, is actuated.

The latch is released manually by pivoting the pawl 3 counterclockwise with the cylinder 27 or by pivoting the lever 4 manually counterclockwise by means of an emergency lever 24. Normally it is released remotely by energizing the motor 17 to rotate the cam 5 counterclockwise through about 180., that is until the roller 20 rides up on the edge 5*b* again. This counter-clockwise pivoting of the cam 5 brings its end edge 5*a* into contact with the pin 21 and pivots the lever 4 counterclockwise, thereby pushing the arm 3*b* of the pawl 3 also counterclockwise with the lever end 22 to raise its arm 3*a* and allow the fork 2 to pivot counterclockwise into the release position shown in dot-dash lines in FIG. 1.

If the trunk lid is frozen shut, however, as shown in FIG. 3, the fork 2 will not pivot to the release position. Nonetheless the lever 16 will be urged by its spring 15 to drop the notch 16*d* down over the pin 21, hereby holding the lever 4 in the actuated freeing position. In this position the lever 11 is pivoted so that the switch 9 is actuated, lighting on the dash-board of the car an alarm 28 indicating that the latch is in the open position, regardless of the actual position of the trunk lid.

Subsequent forcing open of the trunk will cause the fork to pivot counterclockwise and engage the abutment 18 against the arm 16*b* of the lever 16, thereby pivoting the lever 16 clockwise to release the pin 21 from the notch 16*d* so that the lever 4 can return to the unactuated position of FIG. 1. This also moves the lever arm 16*a* up to actuate the switch 23 and shut off the alarm light 29.

Figure 4:
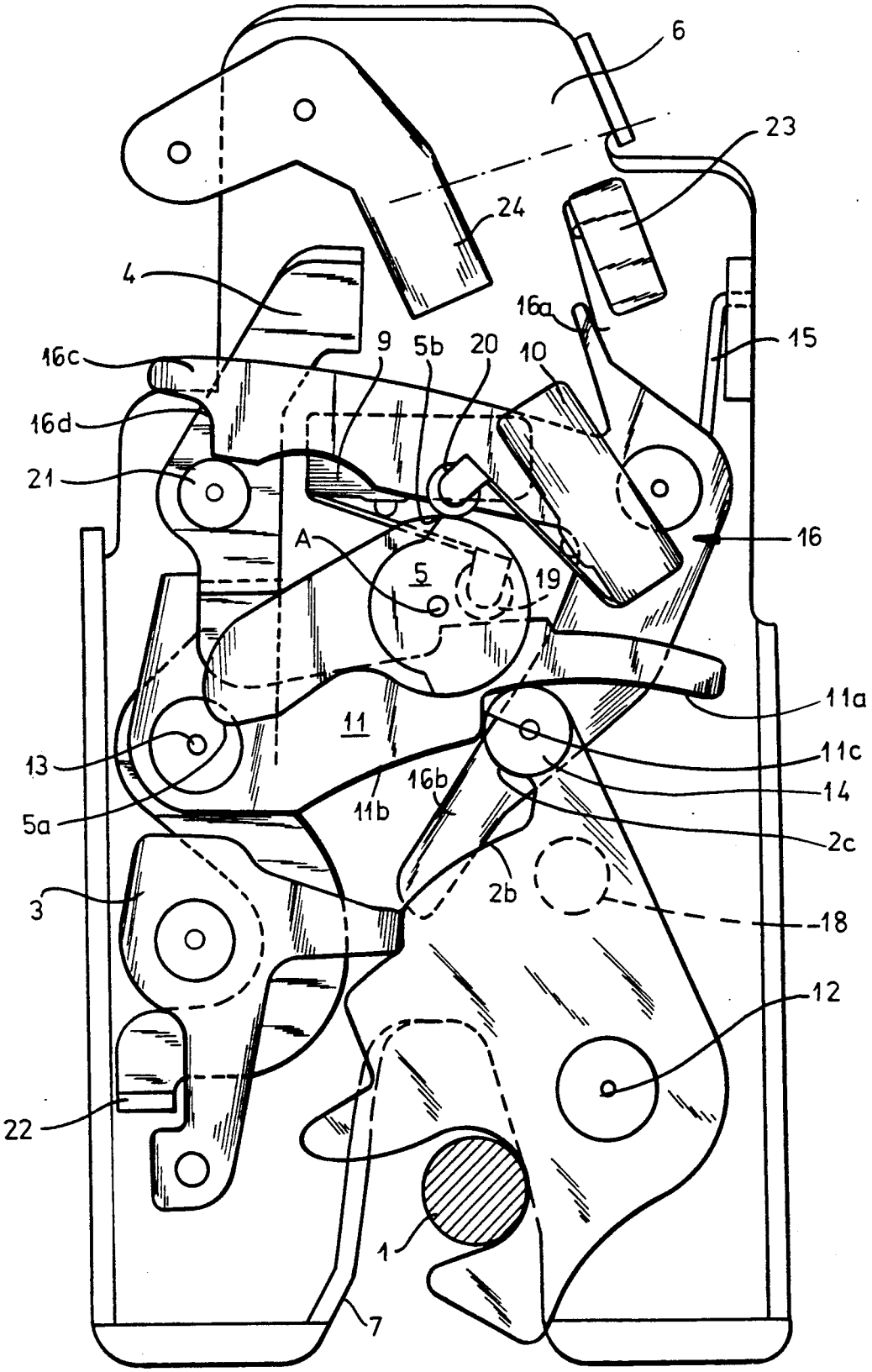
FIG. 4 is a view like FIG. 1 but with the latch in the partially closed position.

From the open position if the trunk is pushed partially shut to pivot the fork 2 into the position of FIG. 4, the pin 14 will ride on the edge 11*b* to pivot the lever 11 and actuate the switch 9. This will start up the motor 17 to rotate the cam 5 through 180°. The end 5*a* of the cam will engage the pin 14 and pivot the lever the rest of the way into the fully locked position, completely closing and latching the trunk lid.

I claim:

1. A motor-vehicle door latch for securing together two relatively movable body parts, the latch comprising:

a housing mounted on one of the parts;

a bolt mounted on the other part and engageable in the housing;

a fork pivotal in the housing between a latched position engaging around the bolt when therein and an unlatched position permitting the bolt to enter and exit the housing;

a pawl pivotal in the housing between a holding position retaining the fork in the latched position and a freeing position permitting the fork to move between its positions;

a release lever engageable with the pawl and pivotal in the housing between a holding position holding the pawl in its freeing position and a freeing position in which it does not impede movement of the pawl between its positions;

means including a motor in the latch for displacing the release lever into the freeing position, the motor being provided with a rotary cam operatively engageable with the release lever to shift same between its positions;

a switch lever operatively engageable with the release lever and movable thereby;

means including another switch associated with the switch lever and operably by same in the holding position of same; and link means between the fork and the switch lever for actuation of the other switch on displacement of the fork into an intermediate position between its latched and unlatched positions;

a position-holding element engageable in the housing with the lever and movable between a blocking position preventing movement of the lever out of the freeing position and an unblocking position permitting movement of the lever between its positions; and means including a switch operatively associated with the holding element for generating an output when same is in the blocking position.

2. The position-holding latch defined in claim 1, further comprising a spring urging the holding element into the blocking position.

3. A motor-vehicle door latch for securing together two relatively movable body parts, the latch comprising:

a housing mounted on one of the parts;

a bolt mounted on the other part and engageable in the housing;

a fork pivotal in the housing between a latched position engaging around the bolt when therein and an unlatched position permitting the bolt to enter and exit the housing;

a pawl pivotal in the housing between a holding position retaining the fork in the latched position and a freeing position permitting the fork to move between its positions;

a release lever engageable with the pawl and pivotal in the housing between a holding position holding the pawl in its freeing position and a freeing position in which it does not impede movement of the pawl between its positions;

means including a motor in the latch for displacing the release lever into the freeing position;

a position-holding element engageable in the housing with the lever and movable between a blocking position preventing movement of the lever out of the freeing position and an unblocking position permitting movement of the lever between its positions;

link means coupling the element to the fork for putting the element in the unblocking position when the fork is in the open position;

a spring urging the holding element into the blocking position; and means including a switch operatively associated with the holding element for generating an output when same is in the blocking position.

4. The position-holding latch defined in claim 1, further comprising a motor-control switch engaging the cam and operable thereby.

* * * * *